US010604824B2

(12) United States Patent
Colombo et al.

(10) Patent No.: US 10,604,824 B2
(45) Date of Patent: Mar. 31, 2020

(54) NANOSTRUCTURED TITANIUM ALLOY AND METHOD FOR THERMOMECHANICALLY PROCESSING THE SAME

(71) Applicant: Manhattan Scientifics, Inc., New York, NY (US)

(72) Inventors: Gian Colombo, Shillington, PA (US); Venkata Anumalasetty, Reading, PA (US); Graham McIntosh, Sinking Spring, PA (US); Yuliya Mardakhayeva, Reading, PA (US)

(73) Assignee: Manhattan Scientifics, Inc., New York, NY (US)

( * ) Notice: Subject to any disclaimer, the term of this patent is extended or adjusted under 35 U.S.C. 154(b) by 0 days.

(21) Appl. No.: 16/398,585

(22) Filed: Apr. 30, 2019

(65) Prior Publication Data

US 2019/0256961 A1 Aug. 22, 2019

Related U.S. Application Data

(63) Continuation of application No. 14/774,182, filed as application No. PCT/US2014/028197 on Mar. 14, 2014, now Pat. No. 10,323,311, which is a continuation-in-part of application No. 13/833,148, filed on Mar. 14, 2013, now abandoned.

(51) Int. Cl.
*C22C 14/00* (2006.01)
*C22F 1/18* (2006.01)

(52) U.S. Cl.
CPC ..... *C22C 14/00* (2013.01); *C22F 1/183* (2013.01)

(58) Field of Classification Search
CPC ..... C22C 14/00; C22F 1/183
See application file for complete search history.

(56) References Cited

U.S. PATENT DOCUMENTS

| | | | |
|---|---|---|---|
| 5,590,389 | A | 12/1996 | Dunlop et al. |
| 5,780,755 | A | 7/1998 | Dunlop et al. |
| 6,197,129 | B1 | 3/2001 | Zhu et al. |
| 6,370,930 | B1 | 4/2002 | Lee et al. |
| 6,399,215 | B1 | 6/2002 | Zhu et al. |
| 6,883,359 | B1 | 4/2005 | Hartwig, Jr. |
| 6,895,795 | B1 | 5/2005 | Chaudhury et al. |
| 6,912,885 | B2 | 7/2005 | Keener et al. |
| 7,077,755 | B2 | 7/2006 | Keener et al. |
| 7,152,448 | B2 | 12/2006 | Zhu et al. |
| 7,241,328 | B2 | 7/2007 | Keener |
| 7,481,091 | B1 | 1/2009 | Grant et al. |
| 7,785,530 | B2 | 8/2010 | Keener |
| 8,168,012 | B2 | 5/2012 | Steinemann |
| 8,211,164 | B2 | 7/2012 | Kramer-Brown et al. |
| 8,919,168 | B2 | 12/2014 | Valiev et al. |
| 10,323,311 | B2 | 6/2019 | Colombo et al. |
| 2005/0126666 | A1 | 6/2005 | Zhu et al. |
| 2006/0021878 | A1 | 2/2006 | Lu et al. |
| 2006/0213592 | A1 | 9/2006 | Ko et al. |
| 2007/0183118 | A1 | 8/2007 | Fu et al. |
| 2009/0126444 | A1 | 5/2009 | Rosochowski |
| 2010/0075168 | A1 | 3/2010 | Schaffer |
| 2010/0107628 | A1 | 5/2010 | Schaffer |
| 2012/0060981 | A1 | 3/2012 | Forbes Jones et al. |
| 2012/0160378 | A1 | 6/2012 | Park et al. |
| 2013/0078139 | A1 | 3/2013 | Lowe et al. |
| 2013/0284325 | A1 | 10/2013 | Lee et al. |

FOREIGN PATENT DOCUMENTS

| | | |
|---|---|---|
| CZ | 302421 | 5/2011 |
| DE | 102009050543 | 5/2011 |
| EP | 1787735 | 5/2007 |
| EP | 2366808 | 8/2014 |
| JP | 2008-101234 | 5/2008 |
| JP | 2011-068955 | 4/2011 |
| JP | 2012-506290 | 3/2012 |
| JP | 2012-111991 | 6/2012 |
| JP | 2013-503970 | 2/2013 |
| RU | 2417957 | 5/2011 |
| WO | 2010/047620 | 4/2010 |
| WO | 2010/049949 | 5/2010 |
| WO | 2011/027943 | 3/2011 |
| WO | 2011/073745 | 6/2011 |
| WO | 2012/071600 | 6/2012 |
| WO | 2014/143983 | 9/2014 |

OTHER PUBLICATIONS

Office Action dated Jul. 9, 2019 in related Brazilian Patent Application No. BR1120150237541. 6 pages.

Office Action dated Aug. 8, 2019 in related Brazilian Patent Application No. BR1120160212240. 4 pages.

Shin, D. H., et al. "Microstructrue development during equal-channel angular pressing of titanium." Acta Materialla 51.4 (2003): 983-996.

International Search Report dated Jun. 12, 2014 in International Patent Application No. PCT/US2014/028197.

Briant, C. L., Z. F. Wang , and N. Chollocoop. "Hydrogen embrittlement of commerical purity titanium." Corrosion Science 44.8 (2002): 1875-1888.

ASTM International: F1108-4 "Standard Specification for Titanium-6Aluminum-4Vanadium Alloy Castings for Surgical Implants (UNS R56406)" Published Apr. 2009, 4 pages.

ASTM International: F1295-11 "Standard Specification for Wrought Titanium-6Aluminum-7Niobium Alloy for Surgical Implant Applications (UNS R56700)" Published Dec. 2011, 6 pages.

ASTM International: F136-12a "Standard Specification forWrought Titanium-6Aluminum-4Vanadium ELI (Extra Low Interstitial) Alloy for Surgical Implant Applications (UNS R56401 )" Published Dec. 2012, 5 pages.

ASTM International: F67-06 "Standard Specification for Unalloyed Titanium, for Surgical Implant Applications (UNS R50250, UNS R50400, UNS R50550, UNS R50700)" Published Jun. 2006, 5 pages.

(Continued)

*Primary Examiner* — Jessee R Roe
(74) *Attorney, Agent, or Firm* — V Gerald Grafe

(57) ABSTRACT

A nanostructured titanium alloy article is provided. The nanostructured alloy includes a developed titanium structure having at least 80% of grains of a grain size≤1.0 microns.

20 Claims, 21 Drawing Sheets

(56) References Cited

OTHER PUBLICATIONS

Carpenter Technical Datasheet "Titanium Alloy Ti 6Al-4V" Edition date Jul. 1, 2000, 10 pages.
Semenova, I P et al: "Enhanced fatigue properties of ultrafine-grained Ti rods processed by ECAP-Conform", Journal of Materials Science, Kluwer Academic Publishers, BO, vol. 47, No. 22, Jul. 6, 2012 (Jul. 6, 2012), pp. 7777-7781, XP035107879, ISSN: 1573-4803, DOI: 10.1007/S10853-012-6675-9.
EPO Search Report dated Oct. 10, 2017 in related EP Application No. 15811866.1.
EPO Search Report dated Dec. 14, 2017 in related EP Application No. 14720383.0.
Office Action dated Mar. 20, 2018 in related Japanese Patent Application No. 2016-502729.
Medvedev—Effect of bulk microstructure of commercially pure titanium on surface characteristics and fatigue properties after surface modification by sand blasting and acid-etching, Journal of the Mechanical Behavior of Biomedical Materials 51 (2016) 55-68. 14 Pages.
Medvedev—Comparison of laboratory-scale and industrial-scale equal channel angular pressing of commercial purity titanium, Materials Letters, Apr. 2016. 5 pages.
N Reshetnikova—NanoSPD activity in Ufa and International Cooperation, IOP Science, Feb. 12, 2015. 7 pages.
Office Action dated Nov. 17, 2015 in related U.S. Appl. No. 13/833,148. 10 pages.
Office Action dated Apr. 7, 2016 in related U.S. Appl. No. 13/833,148. 17 pages.
Office Action dated Oct. 11, 2016 in related U.S. Appl. No. 13/833,148. 21 pages.
Office Action dated Nov. 3, 2016 in related U.S. Appl. No. 14/212,344. 17 pages.
Office Action dated Apr. 4, 2016 in related U.S. Appl. No. 14/212,344. 21 pages.
Juno Gallego, "Microstructural characterization of Ti—6Al—7Nb alloy after severe plastic deformation", Materials Research vol. 15 No. 5. Oct 1, 2012. pp. 786-791.
Ko Y G. "Low-temperature superplasticity of ultra-fine-grained Ti—6Al—4V processed by equal-channel angular pressing". Metallurgical and materials transactions A, Springer-Verlaf, New York. vol. 37 No. 2. Feb. 1, 2006.
Office Action dated Feb. 19, 2019 in related Japanese Patent Application No. 2016-502729. 4 pages.
U.S. Appl. No. 14/774,182, filed Sep. 10, 2015, now U.S. Pat. No. 10,323,311.

NANOSTRUCTURED TITANIUM ALLOY AND METHOD FOR THERMOMECHANICALLY PROCESSING THE SAME

CROSS-REFERENCE TO RELATED APPLICATIONS

This application is a continuation of U.S. patent application Ser. No. 14/774,182, filed Sep. 10, 2015, now U.S. Pat. No. 10,323,311, and entitled NANOSTRUCTURED TITANIUM ALLOY AND METHOD FOR THERMOMECHANICALLY PROCESSING THE SAME, which is a national-stage entry of International Parent Application No. PCT/US2014/028197, filed Mar. 14, 2014, and entitled NANOSTRUCTURED TITANIUM ALLOY AND METHOD FOR THERMOMECHANICALLY PROCESSING THE SAME, which is a continuation-in-part of U.S. patent application Ser. No. 13/833,148, filed Mar. 15, 2013, and entitled NANOSTRUCTURED TITANIUM ALLOY AND METHOD FOR THERMOMECHANICALLY PROCESSING THE SAME. The entire disclosures of all of the above-mentioned application are hereby expressly incorporated herein by reference.

FIELD OF THE INVENTION

The invention elates to a nanostructured material and, more particularly, a nanostructured titanium alloy having a developed α-titanium structure with enhanced material properties.

BACKGROUND

It is known that microstructure plays a key role in the establishment of mechanical properties. Depending on the processing method, a material's structure can be developed to enhance material properties. For instance, it is possible to modify the grain or crystalline structure of the material using mechanical, or thermo-mechanical processing techniques.

United States Patent Application 2011/0179848 discloses a commercially pure titanium product having enhanced properties for biomedical applications. The titanium product has a nanocrystalline structure, which provides enhanced properties in relation to the original mechanical properties, including mechanical strength, resistance to fatigue failure, and biomedical properties. It is disclosed that the known titanium product is first subject to severe plastic deformation (SPD) using an equal channel angular pressing (ECAP) technique at a temperature no more than 450° C. with the total true accumulated strain e≥4, and then subsequently developed using thermomechanical treatment with a strain degree from 40% to 80%. In particular, the thermomechanical treatment includes plastic deformation performed with a gradual decrease of temperature in the range T−450 . . . 350° C. and the strain rate of $10^{-2}$ . . . $10^{-4}$ $s^{-1}$.

While this known technique achieves a higher level of mechanical properties for commercially pure titanium, there is a need to increase the level of tensile and/or shear strength, as well as fatigue properties in titanium alloys for various engineering applications, including but not limited to biomedical, energy, high performance sporting goods, and aerospace applications.

SUMMARY

In view of these shortcomings, an object of the invention, among others, is to increase the level of strength and fatigue resistance of a titanium alloy.

As a result, a nanostructured titanium alloy article is provided. The nanostructured alloy includes a developed titanium structure having at least 80% of grains of a size≤1.0 microns. The present application is related to U.S. application Ser. No. 14/774,182, filed Sep. 10, 2015, which is incorporated herein by reference.

BRIEF DESCRIPTION OF THE DRAWINGS

Exemplary embodiments of the invention will be described with reference to the accompanying drawings, of which.

DETAILED DESCRIPTION OF THE EMBODIMENT(S)

The invention is a nanostructured titanium alloy that can be used in different industries for production of various useful articles, such as orthopedic implants, medical and aerospace fasteners, aerospace structural components, and high performance sporting goods. In an exemplary embodiment of the invention, a composition of commercially pure titanium, having an α-titanium matrix that may contain retained β-titanium particles, is processed to develop the structure to achieve a nanostructure with at least 80% of the grains being ≤1 micron. As a result, the nanostructured titanium alloy exhibits various material property changes such as an increase in tensile strength and/or shear strength and/or fatigue endurance limit. In particular, the nanostructured titanium alloy structure is developed using a combination of thermomechanical processing steps according to the invention. This process provides a developed microstructure having a preponderance of ultrafine grain and/or nanocrystalline structures.

Figure 1:
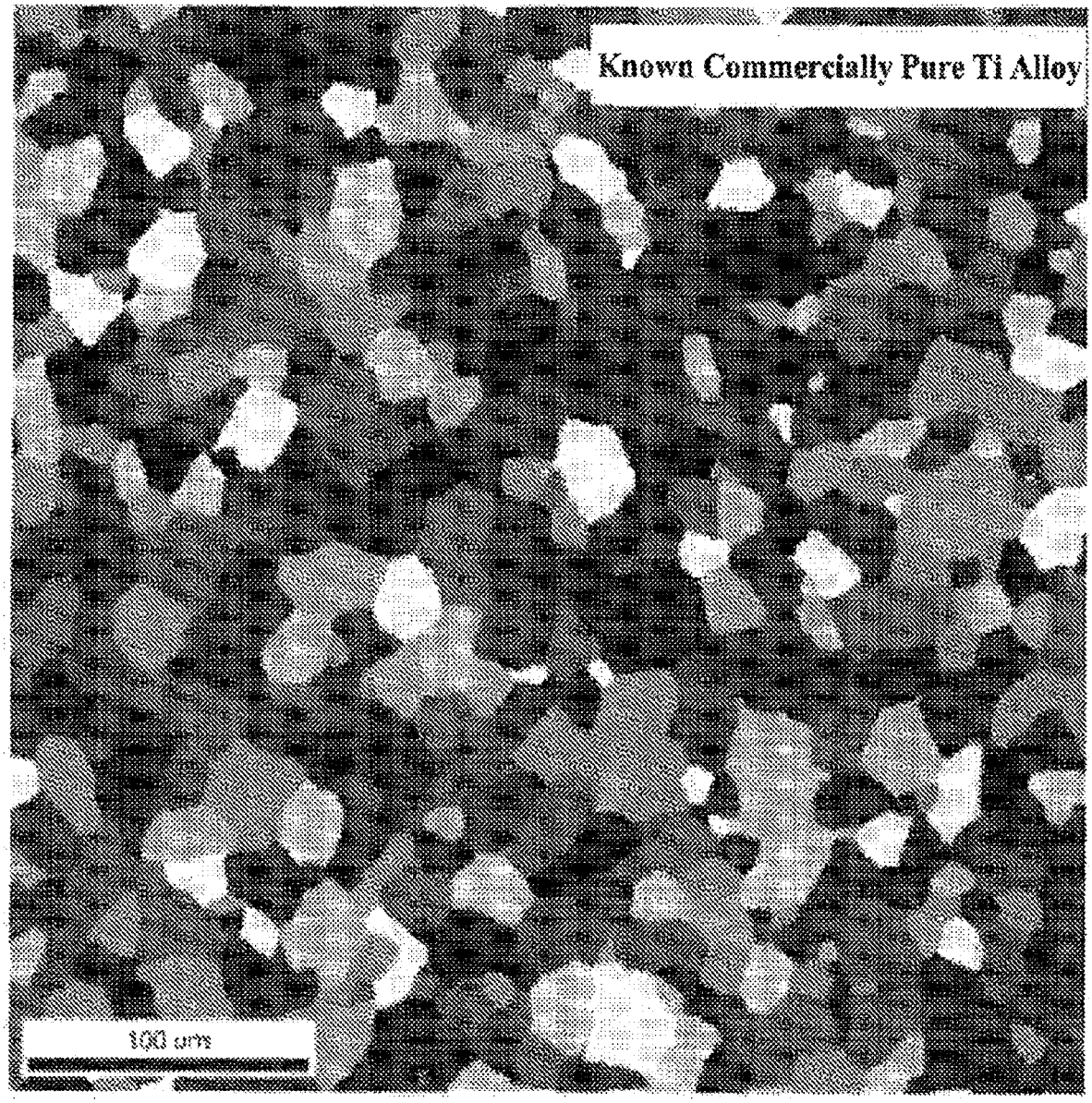
FIG. 1 is a micrograph of a known commercially pure titanium alloy taken using electron back scatter diffraction.
Figure 2:
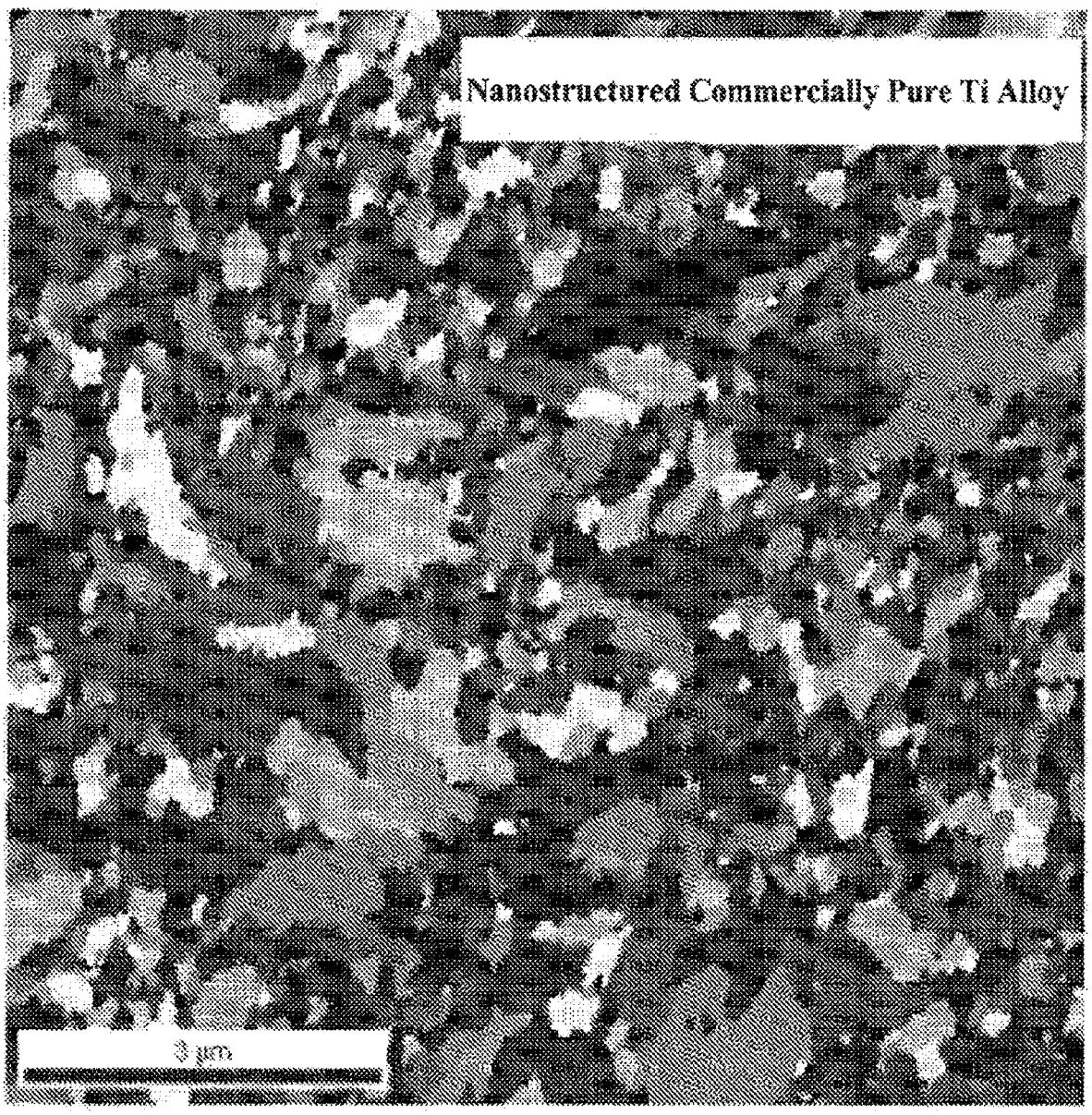
FIG. 2 is a micrograph of a nanostructured commercially pure titanium alloy according to the invention taken using electron back scatter diffraction.
Figure 12:
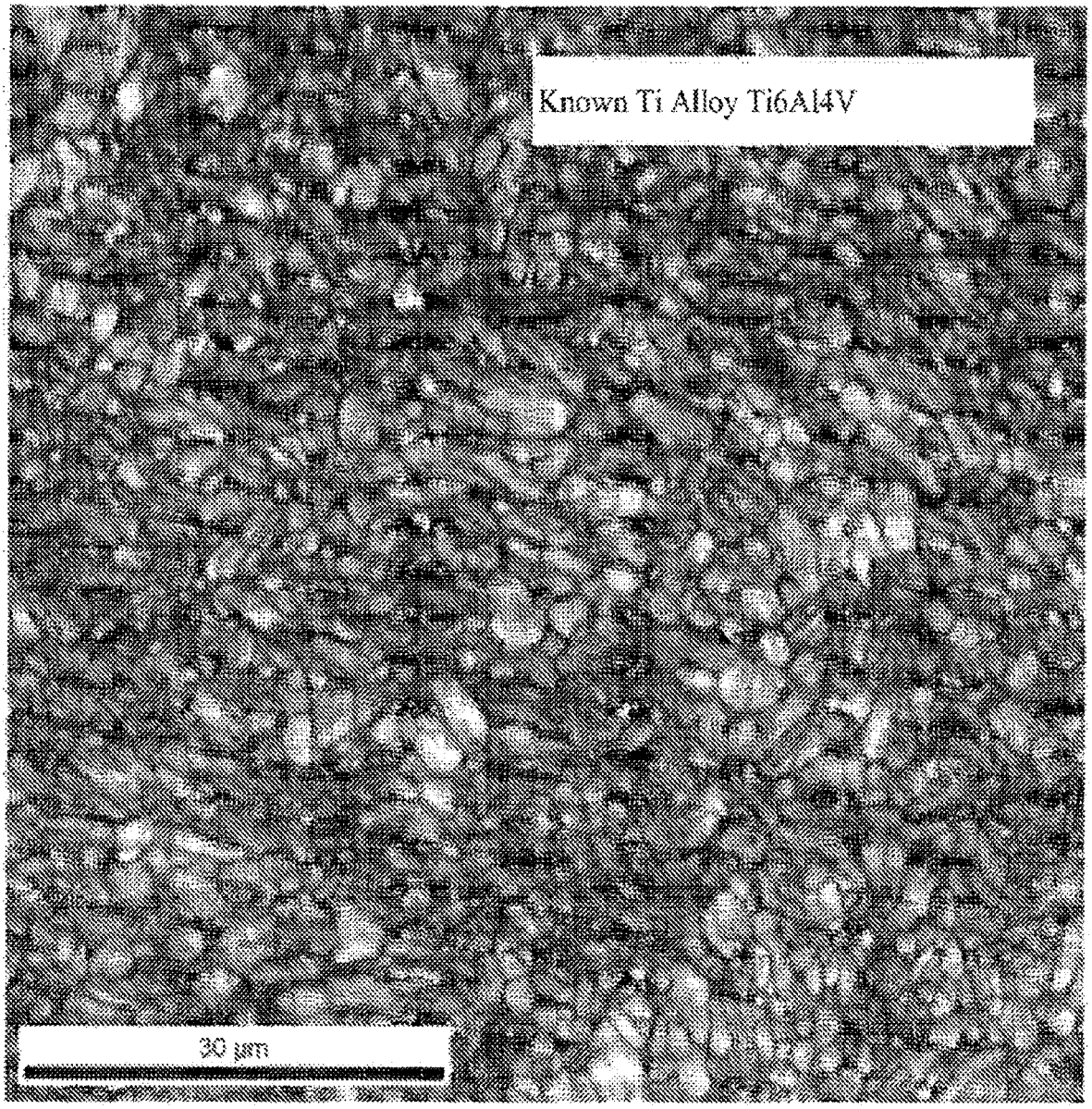
FIG. 12 is a micrograph of a known titanium alloy Ti6Al4V taken using electron back scatter diffraction.
Figure 13:
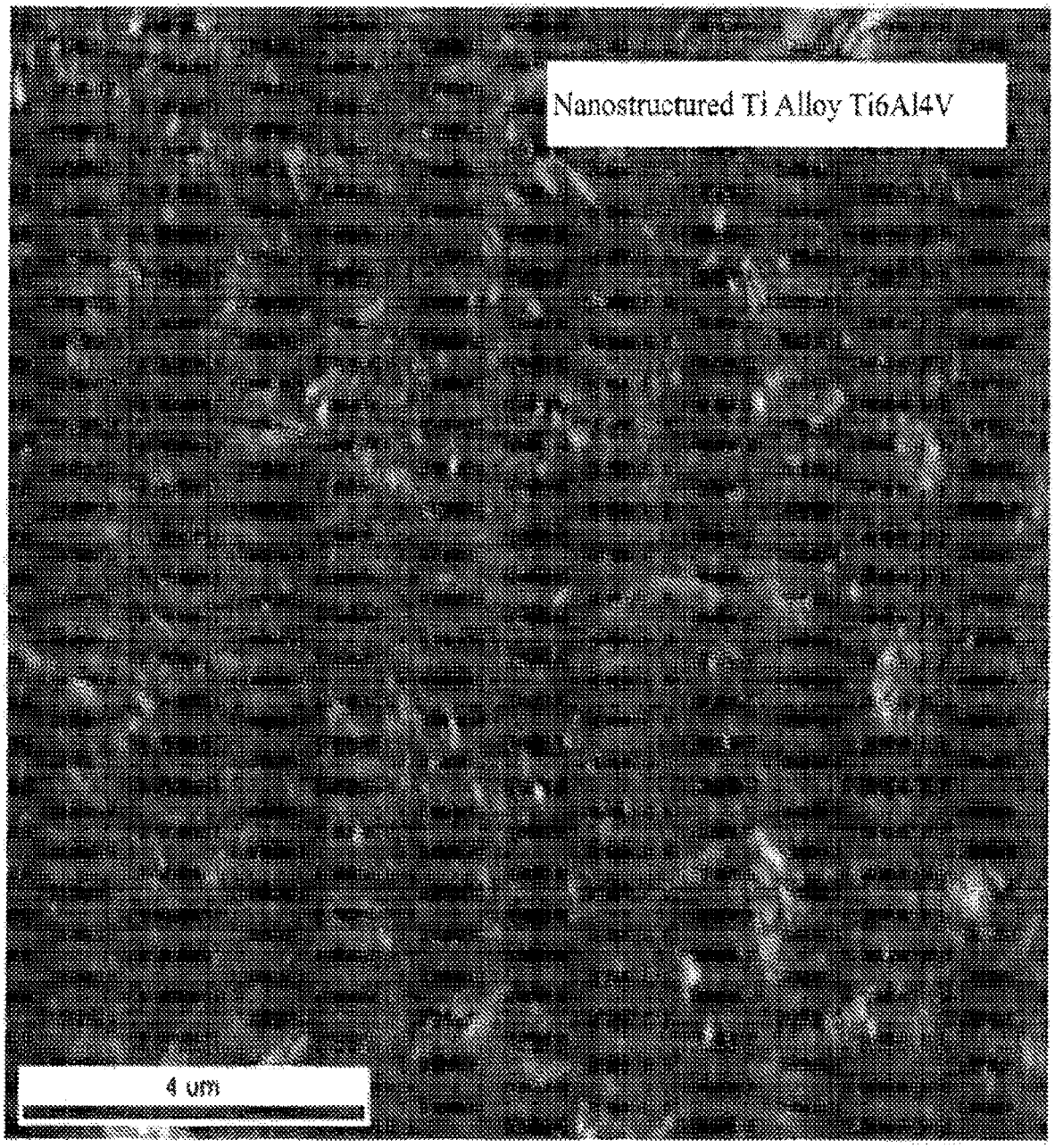
FIG. 13 is a micrograph of a nanostructured titanium alloy Ti6Al4V according to the invention taken using electron back scatter diffraction.
Figure 17:
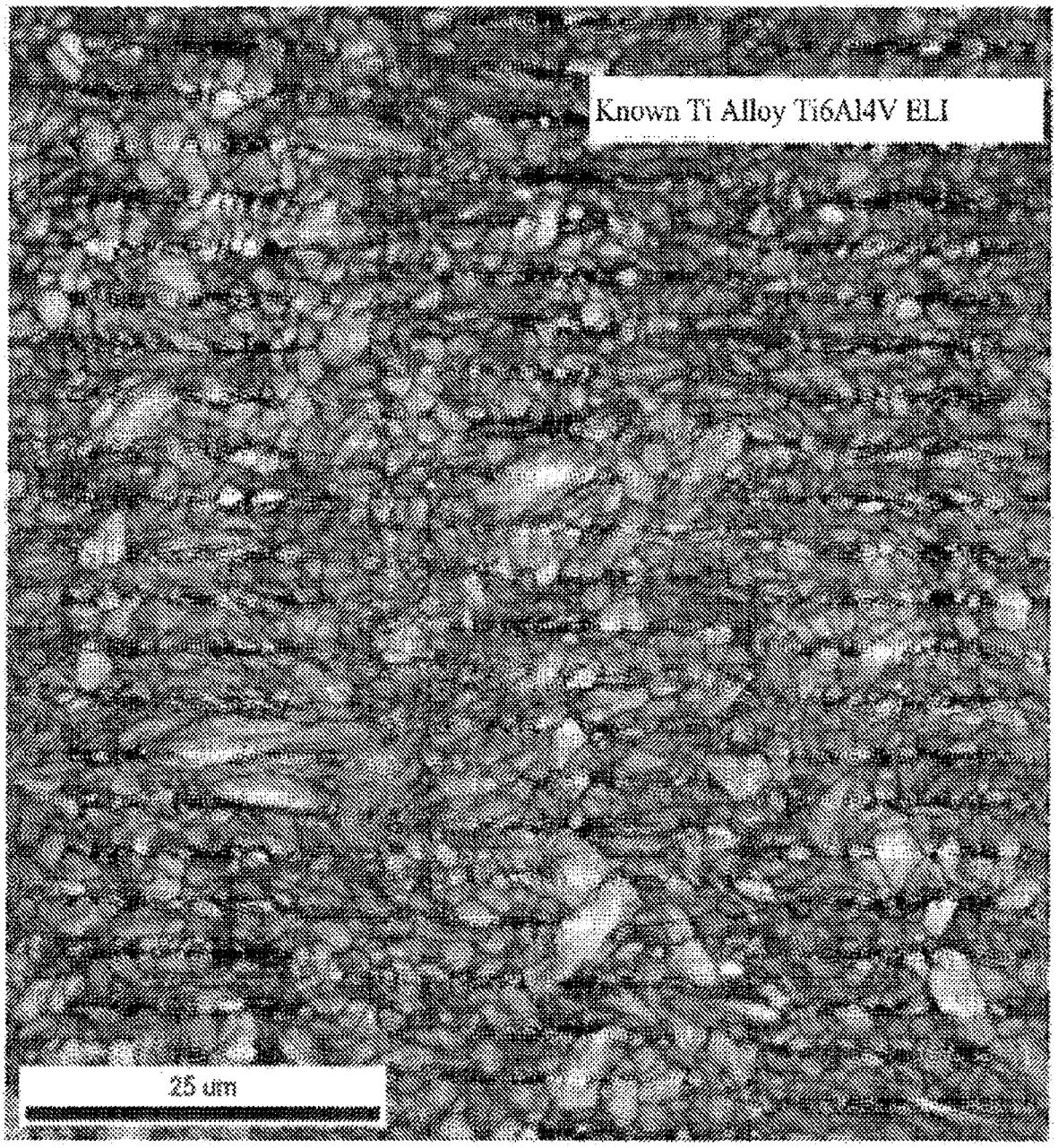
FIG. 17 is a micrograph of a known titanium alloy Ti6Al4V ELI taken using electron back scatter diffraction.
Figure 18:
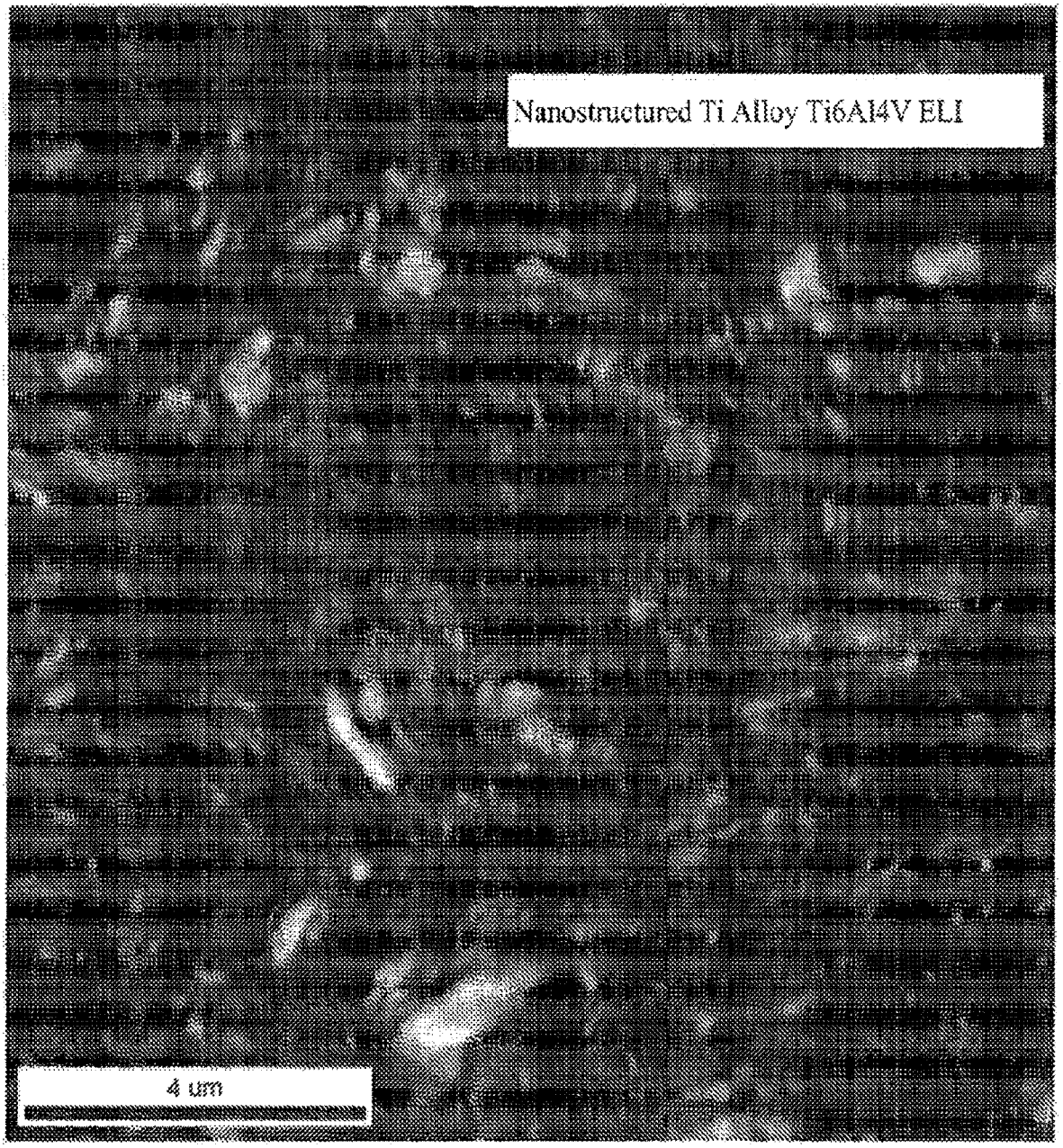
FIG. 18 is a micrograph of a nanostructured titanium alloy Ti6Al4V ELI according to the invention taken using electron back scatter diffraction.

FIGS. 1, 12, and 17 show the starting commercially pure titanium alloy, Ti6Al4V, and Ti6Al4V ELI microstructure, respectively. FIGS. 2, 13, and 18 show the resulting structure of the nanostructured commercially pure titanium alloy, Ti6Al4V, and Ti6Al4V ELI according to the invention, respectively. Examination of the figures clearly shows the difference between the staring and nanostructure titanium alloys.

The workpiece can be comprised of various commercially available titanium alloys known in the art, such as commercially pure titanium alloys (Grades 1-4), Ti-6Al-4V, Ti-6Al-4V ELI, Ti-6Al-7Nb, Ti—Zr, or other known alpha, near alpha, and alpha-beta phase titanium alloys.

Accordingly, in other exemplary embodiments of the invention, an alpha-beta phase titanium alloy is processed from a combination of a severe plastic deformation process type and non-severe plastic deformation type thermomechanical processing steps to develop a nanostructure with at least 80% of the grains being ≤1 micron.

In an exemplary embodiment of the invention, a coarse grain commercially pure titanium alloy is used for the workpiece, which has the following composition by weight percent: nitrogen (N) 0.07% maximum, carbon (C) 0.1% maximum, hydrogen (H) 0.015% maximum, iron (Fe) 0.50% maximum, oxygen (0) 0.40% maximum, total of other trace impurities is 0.4% maximum, and titanium (Ti) as the balance.

Other titanium alloys may be used, including but not limited to other commercially pure titanium alloys, Ti-6Al-4V, Ti-6Al-4V ELI, Ti-6Al-7Nb, and Ti—Zr. Standard chemical compositions of these titanium alloys can be found in Tables 1-3, which identify the standard chemical compositions by wt % max. (ASTM B348-11, Standard specification for Titanium and Titanium Alloy Bars and Billets; ASTM F1295-11 Standard Specification for Wrought Titanium-6Aluminum-7Niobium Alloy for Surgical Implant Applications; ASTM F136-12a Standard Specification for Wrought Titanium-6Aluminum-4Vanadium ELI (Extra Low Interstitial) Alloy for Surgical Implant Applications; and Titanium Alloy Ti—Zr, U.S. Pat. No. 8,168,012).

TABLE 1

Commercially Pure Ti - Chemical Compositions, wt % max

| Designation | N | C | H | Fe | O | Total of other elements | Ti |
|---|---|---|---|---|---|---|---|
| CP Ti (ASTM Grade1) | 0.03 | 0.08 | 0.015 | 0.20 | 0.18 | 0.4 | balance |
| CP Ti (ASTM Grade 2) | 0.03 | 0.08 | 0.015 | 0.30 | 0.25 | 0.4 | balance |
| CP Ti (ASTM Grade 3) | 0.05 | 0.08 | 0.015 | 0.30 | 0.35 | 0.4 | balance |
| CP Ti (ASTM Grade 4) | 0.05 | 0.08 | 0.015 | 0.50 | 0.40 | 0.4 | balance |

TABLE 2

Ti—6Al—4V, Ti—6Al—4V ELI, Ti—6Al—7Nb - Chemical Compositions, wt % max

| Designation | N | C | H | Fe | O | Al | V | Total of other elements | Ti |
|---|---|---|---|---|---|---|---|---|---|
| Ti—6Al—4V | 0.05 | 0.08 | 0.015 | 0.40 | 0.2 | 5.5-6.75 | 3.5-4.5 | 0.4 | balance |
| Ti—6Al—4V ELI | 0.05 | 0.08 | 0.012 | 0.25 | 0.13 | 5.5-6.5 | 3.5-4.5 | 0.4 | balance |

| Designation | N | C | H | Fe | O | Al | Nb | Ta | Ti |
|---|---|---|---|---|---|---|---|---|---|
| Ti—6Al—7Nb | 0.05 | 0.08 | 0.009 | 0.25 | 0.20 | 5.50-6.50 | 6.50-7.50 | 0.5 | balance |

TABLE 3

| Ti—Zr- Chemical Compositions, wt % | | | | |
|---|---|---|---|---|
| Designation | Zr | 0 | Other | Ti |
| Ti—Zr | 9.9-19.9 | 0.1-9.3 | 1.0 max | balance |

The workpiece, for instance a rod or bar, is subjected to severe plastic deformation ("SPD") and thermomechanical processing. The combined processing steps induce a large amount of shear deformation that significantly refines the initial structure by creating a large number of high angle grain boundaries (misorientation angle≥15°) and high dislocation density.

In particular, in the exemplary embodiment, the workpiece is processed using an equal channel angular pressing-conform (ECAP-C) machine, which consists of a revolving wheel having a circumferential groove and two stationary dies that form a channel that intersect at a defined angle. However, it is also possible in other embodiments to subject the workpiece to severe plastic deformation using other known process types, including equal-channel angular pressing, equal channel angular extrusion, incremental equal channel angular pressing, equal channel angular pressing with parallel channels, equal channel angular pressing with multiple channels, hydrostatic equal channel angular pressing, cyclic extrusion and compression, dual roll equal channel angular extrusion, hydrostatic extrusion plus equal channel angular pressing, equal channel angular pressing plus hydrostatic extrusion, continuous high pressure torsion, torsional equal channel angular pressing, equal channel angular rolling or equal channel angular drawing.

Firstly, using the ECAP-C machine, the workpiece is pressed into the wheel groove and is driven through the channel by frictional forces generated between the workpiece and the wheel. A commercially pure titanium alloy workpiece is processed through the ECAP-C machine at temperatures below 500° C., preferably 100-300° C. Other titanium alloys: Ti6Al4V, Ti6Al4V ELI, and Ti6Al7Nb are processed through the ECAP-C machine at a temperature below 650° C., preferably 400-600° C. The workpiece passes through the ECAP-C machine between 1 and 12 times, preferably 4 to 8 times. The die is set at an angle of channel intersection between $\psi=75°$ and $\psi=135°$, 90° to 120°, and 100° to 110°. To enable comparable structural evolution, a lower channel intersection angle will require fewer passes and/or higher temperature, and a higher channel intersection angle will require more passes and/or lower temperature. The workpiece is rotated around its longitudinal axis by an angle of 90° between each pass through the ECAP-C machine, which provides homogeneity in the developed structure. This method of rotation is known as ECAP route B. However, in other embodiments, the ECAP route may be changed, including but not limited to known routes A, C, $B_A$, E, or some combination thereof.

After the workpiece has been processed using severe plastic deformation from the ECAP-C processing steps, the workpiece is then subjected to additional thermomechanical processing using non-SPD type metal forming techniques. In particular, the thermomechanical processing further evolves the structure of the workpiece, more than the ECAP-C alone. In the exemplary embodiment, one or more thermomechanical processing steps may be carried out, including but not limited to drawing, rolling, extrusion, forging, swaging, or some combination thereof. In the exemplary embodiment, the thermomechanical processing for commercially pure titanium alloy is carried out at temperatures T≤500° C., preferably room temperature to 250° C. Thermomechanical processing of titanium alloys: Ti6Al4V, Ti6Al4V ELI, and Ti6Al7Nb is carried out at temperatures not greater than 550. degree. C., preferably 400-500° C. Thermomechanical processing provides a cross-sectional area reduction of ≥35%, preferably ≥65%.

The combination of severe plastic deformation and thermomechanical processing substantially refines the initial structure, which consists of an α-titanium matrix that may contain retained β-titanium particles, to a predominantly submicron grain size. In the exemplary embodiment of the invention, the ECAP-C process fragments the starting grain structure by introducing large numbers of twins and dislocations that organize to form dislocation cells with walls having a low misorientation angle <15°.

During thermomechanical processing, dislocation density increases, and some of the low angle cell walls evolve into high angle subgrain boundaries, enhancing strength while retaining usable ductility levels for industrial applications.

In the exemplary embodiment, the resulting nanostructured titanium alloy includes an α-titanium matrix that may contain retained β-titanium particles.

Figure 3:
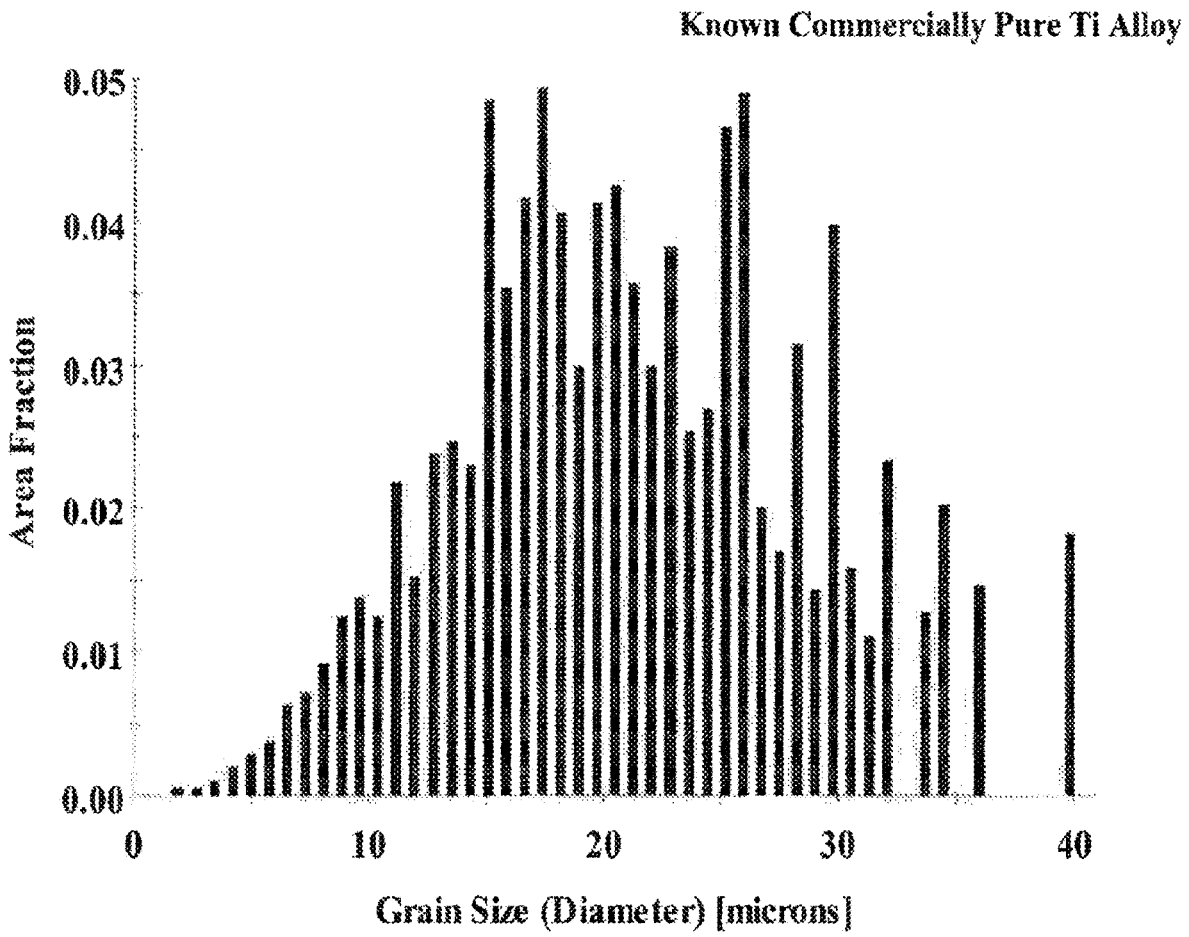
FIG. 3 is a graphical representation, obtained using electron back scatter diffraction, showing the grain size distribution of the known commercially pure titanium alloy.
Figure 4:
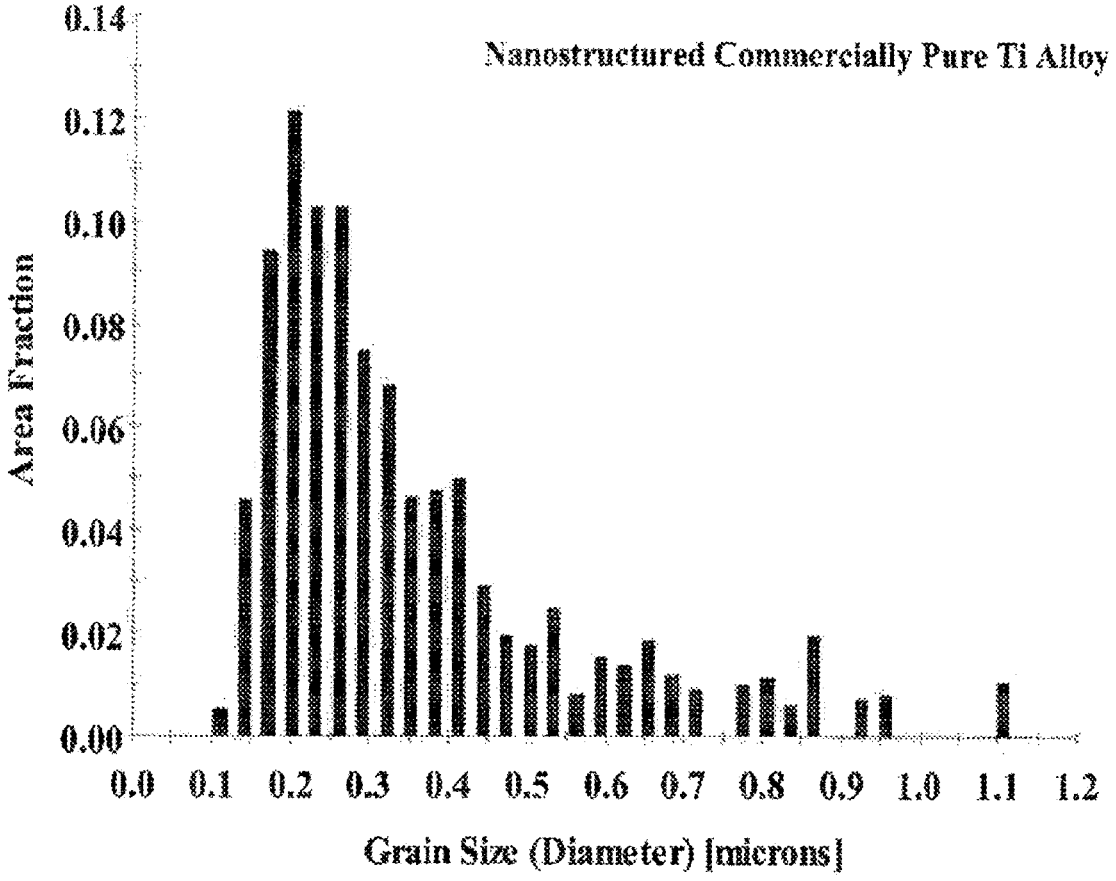
FIG. 4 is a graphical representation, obtained using electron back scatter diffraction, showing the grain size distribution of the nanostructured commercially pure titanium alloy according to the invention.
Figure 5:
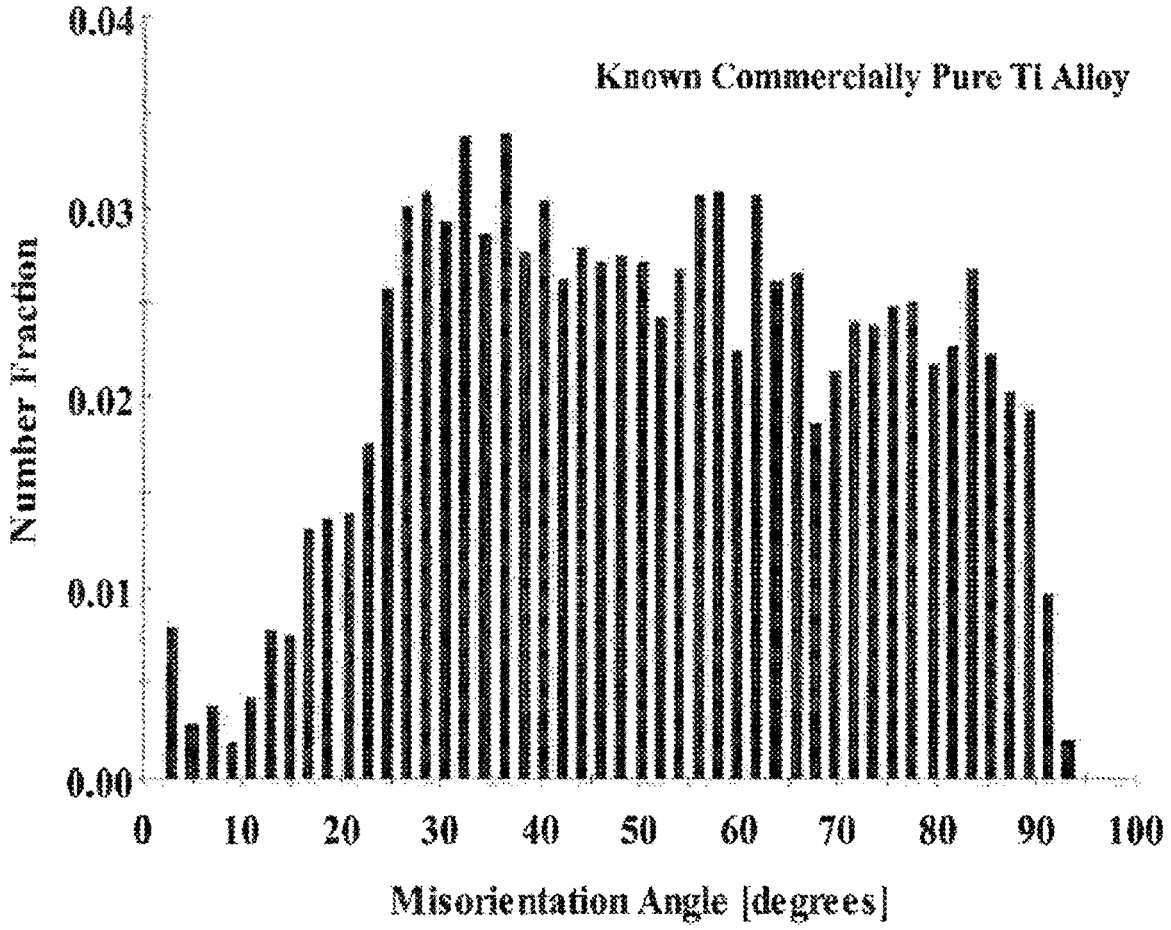
FIG. 5 is a graphical representation, obtained using electron back scatter diffraction, showing the misorientation angle distribution of the known commercially pure titanium alloy.
Figure 6:
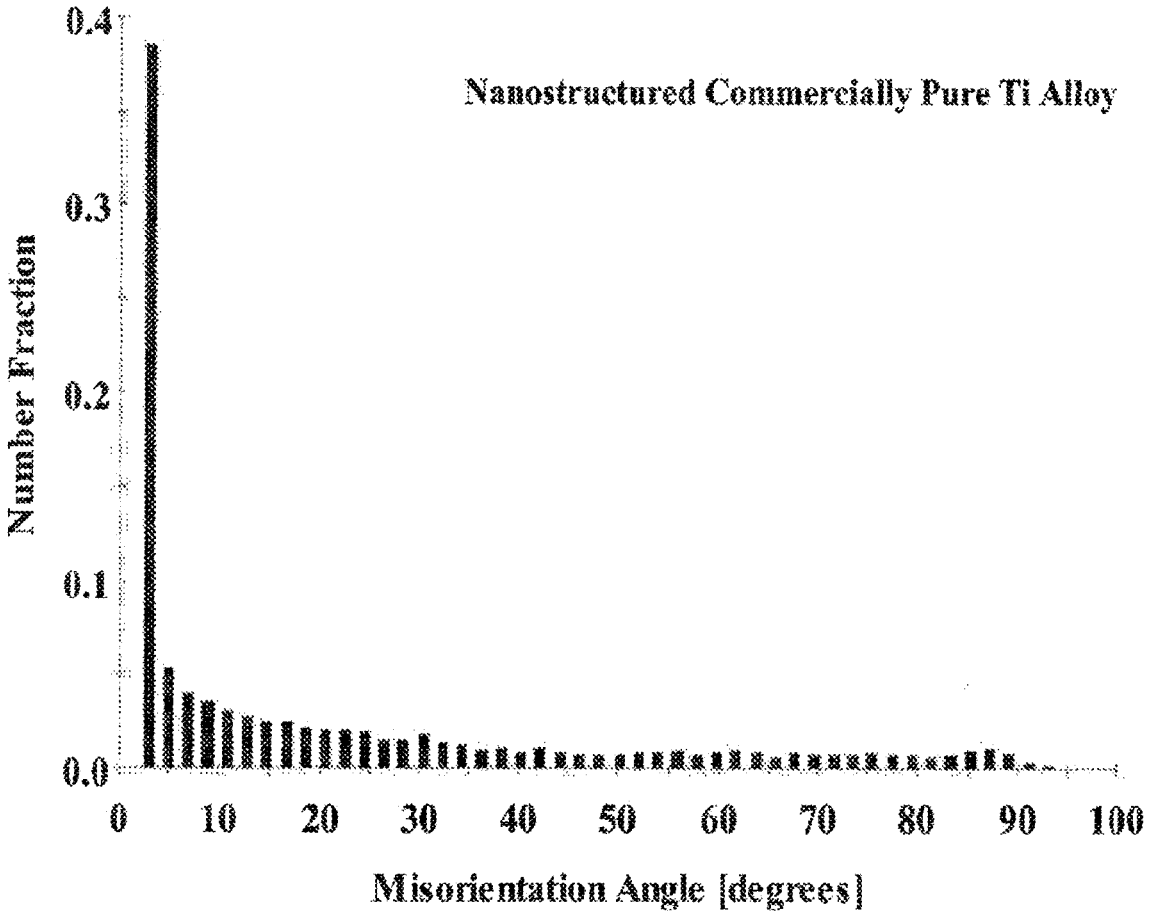
FIG. 6 is a graphical representation, obtained using electron back scatter diffraction, showing the misorientation angle distribution of the nanostructured commercially pure titanium alloy according to the invention.
Figure 14:
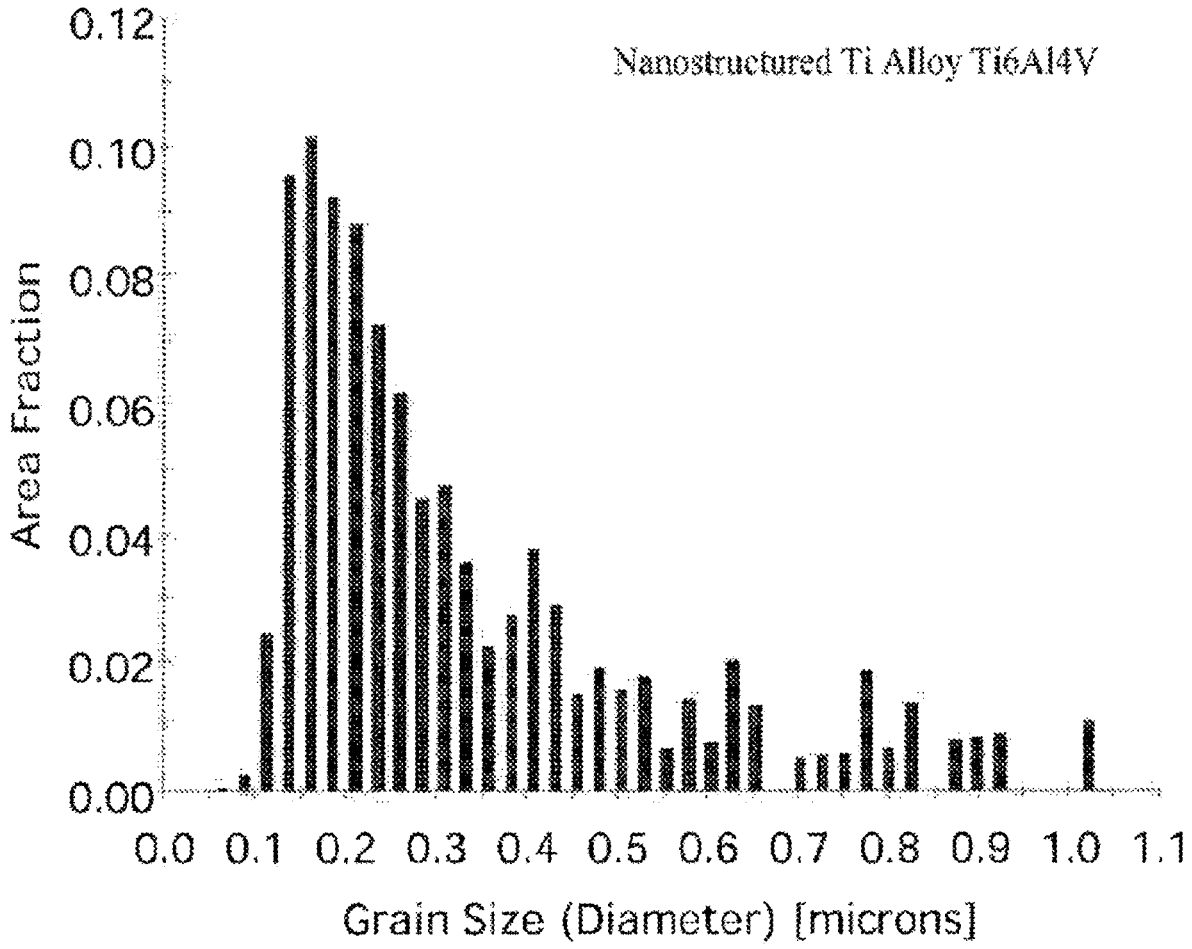
FIG. 14 is a graphical representation, obtained using electron back scatter diffraction, showing the grain size distribution of the nanostructured titanium alloy Ti6Al4V according to the invention.
Figure 15:
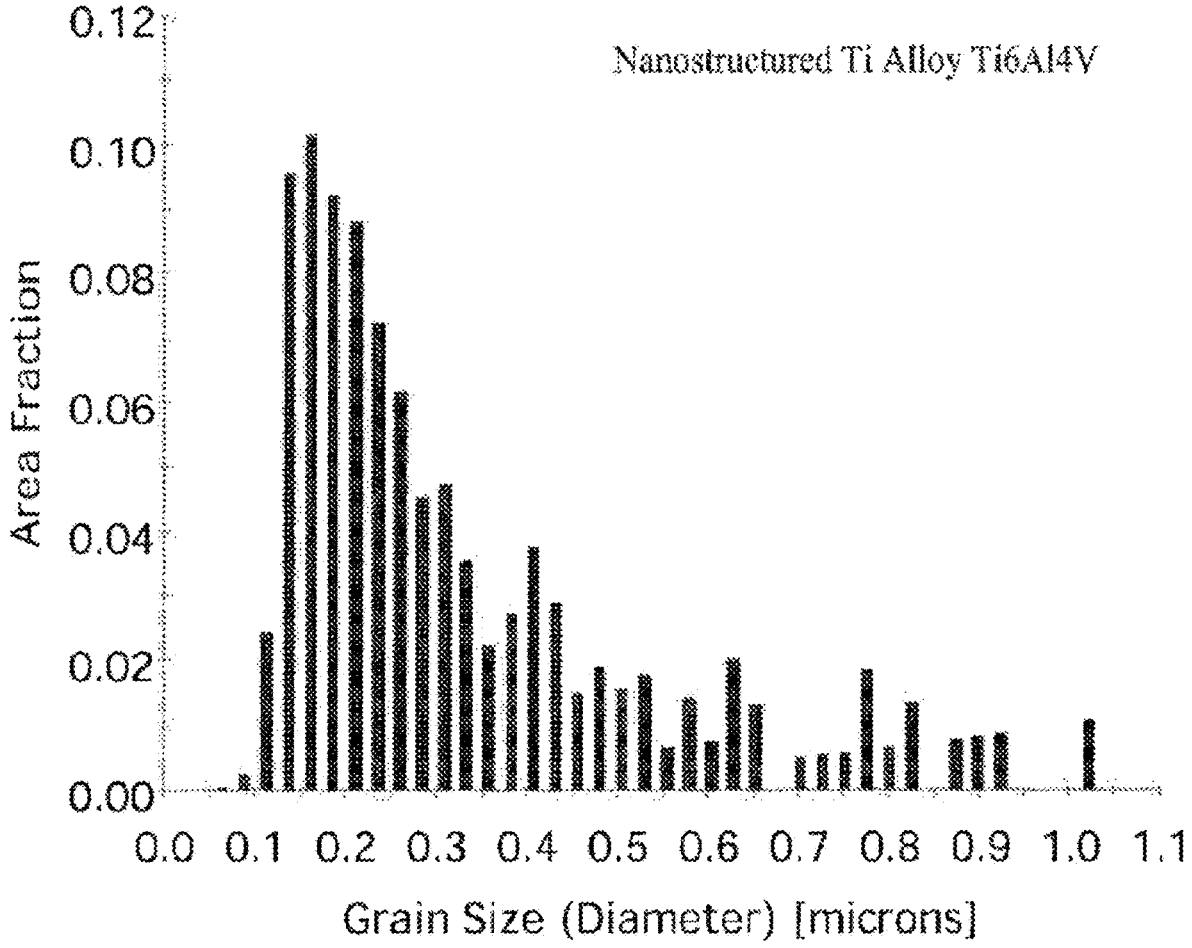
FIG. 15 is a graphical representation, obtained using electron back scatter diffraction, showing the misorientation angle distribution of a known titanium alloy Ti6Al4V.
Figure 16:
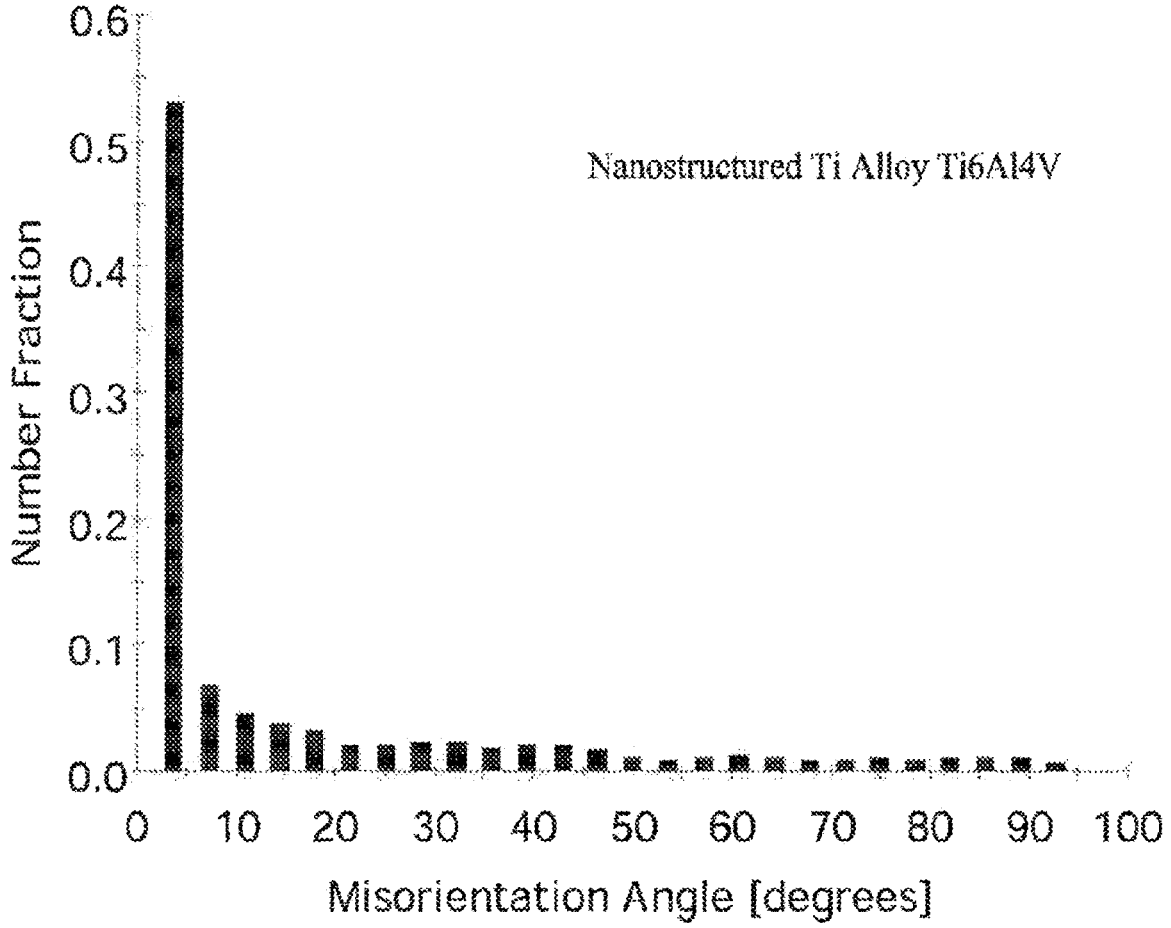
FIG. 16 is a graphical representation, obtained using electron back scatter diffraction, showing the misorientation angle distribution of the nanostructured titanium alloy Ti6Al4V according to the invention.
Figure 19:
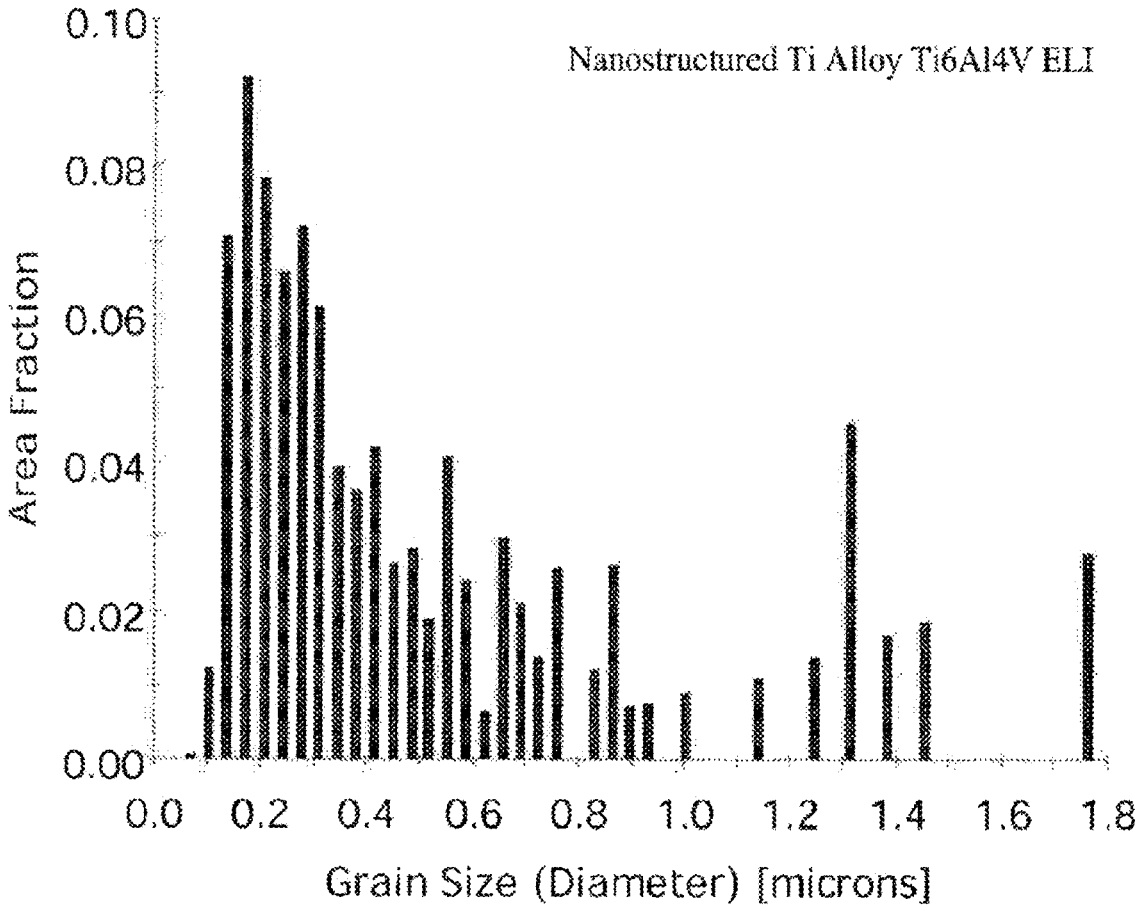
FIG. 19 is a graphical representation, obtained using electron back scatter diffraction, showing the grain size distribution of the nanostructured titanium alloy Ti6Al4V ELI according to the invention.
Figure 20:
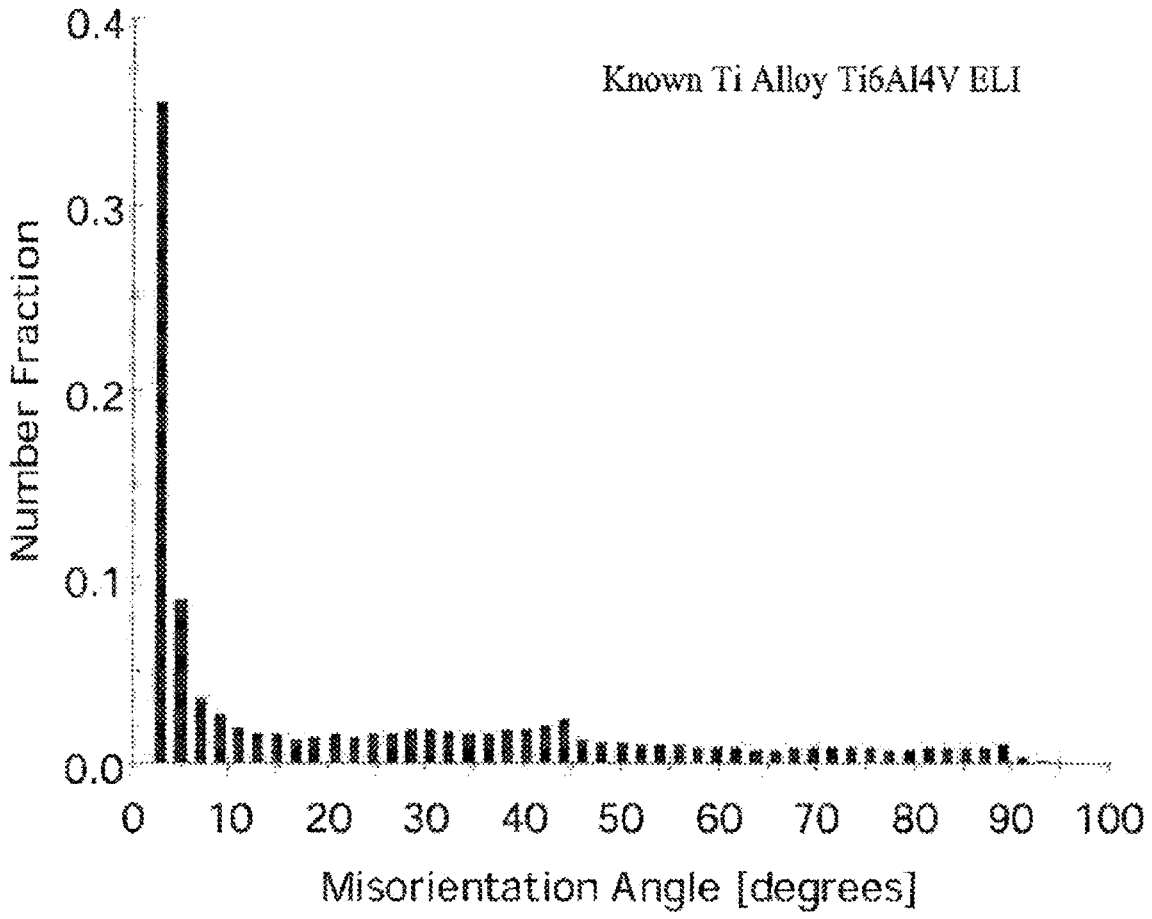
FIG. 20 is a graphical representation, obtained using electron back scatter diffraction, showing the misorientation angle distribution of a known titanium alloy Ti6Al4V ELI.
Figure 21:
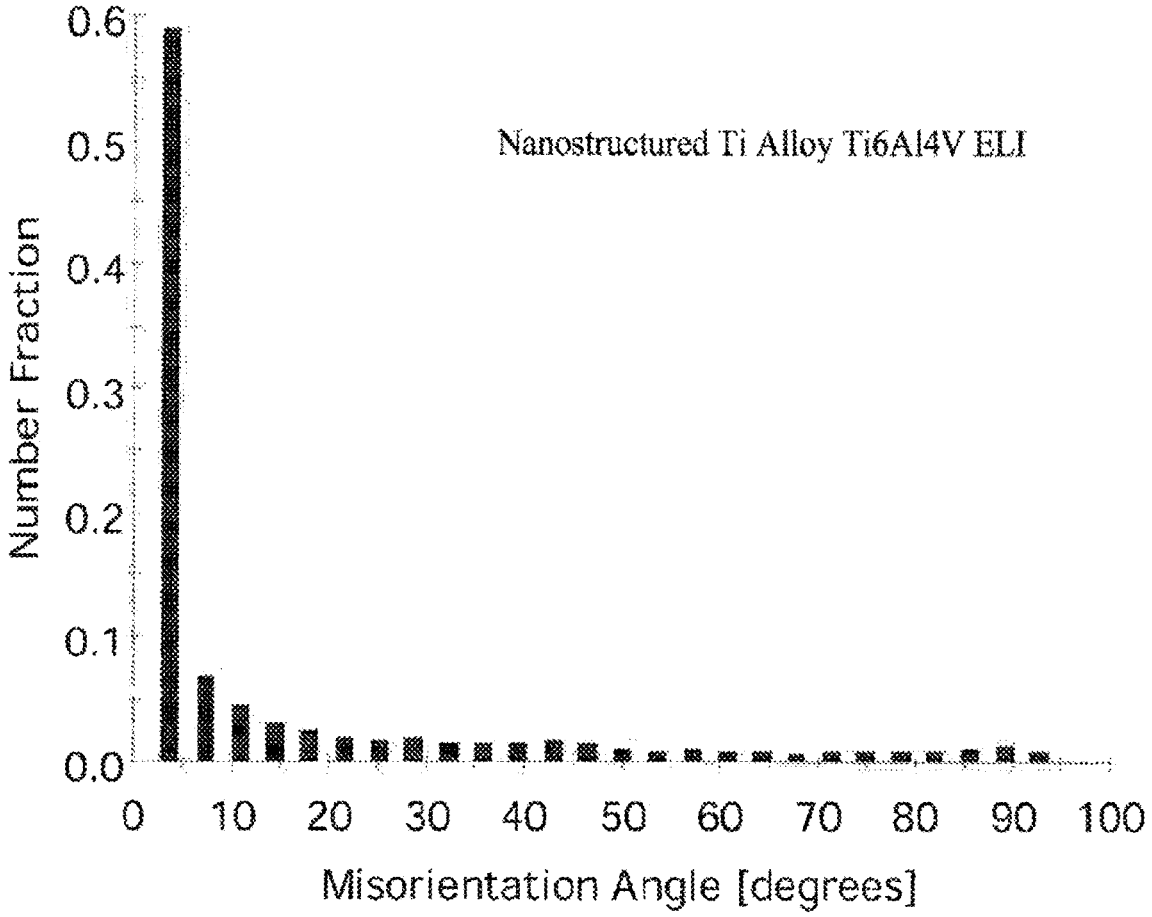
FIG. 21 is a graphical representation, obtained using electron back scatter diffraction, showing the misorientation angle distribution of the nanostructured titanium alloy Ti6Al4V ELI according to the invention.

FIG. 3 is a histogram showing the grain size distribution in the starting commercially pure titanium alloy. FIGS. 4, 14, and 19 are histograms showing the grain size distribution in the nanostructured commercially pure titanium alloy, nanostructured Ti6Al4V, and nanostructured Ti6Al4V ELI, respectively, according to the invention. The average grain size of the nanostructured titanium alloys is reduced from the starting titanium alloys. FIG. 5 shows that the starting commercially pure titanium alloy has 90%-95% of the grain boundaries with misorientation angle ≥15°, while FIG. 6 shows that the nanostructured commercially pure titanium alloy retains 20%-40% of the grain boundaries with misorientation angle ≤15°. FIGS. 15 and 20 show that the starting titanium alloys: Ti6Al4V and Ti6Al4V ELI has 40-55% of the grain boundaries with misorientation angle ≥15°, and FIGS. 16 and 21 show that the nanostructured Ti6Al4V and Ti6Al4V ELI retains 20-40% of the grain boundaries with misorientation angle ≥15°. These distributions contribute to the retention of useful ductility levels.

Figure 7:
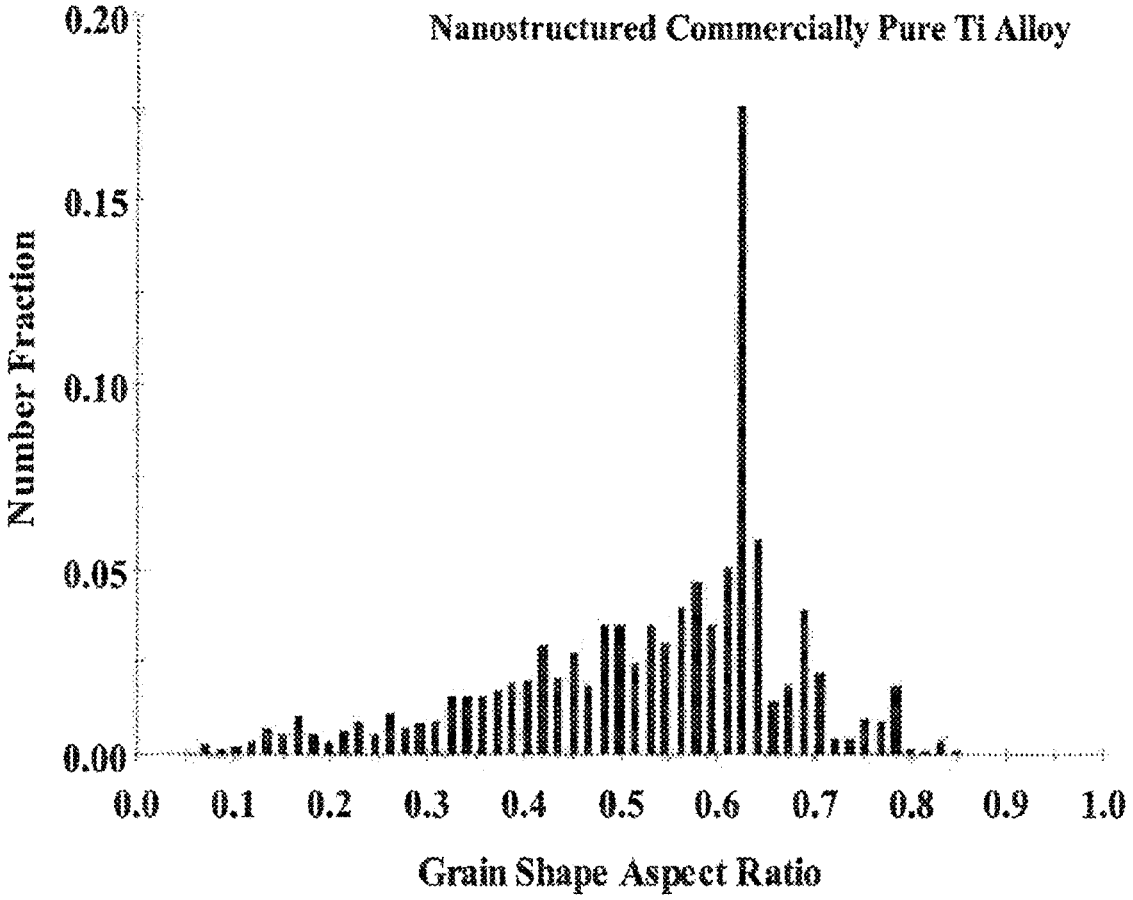
FIG. 7 is a graphical representation, obtained using electron back scatter diffraction, showing the grain shape aspect ratio distribution in the longitudinal plane of the nanostructured commercially pure titanium alloy according to the invention.
Figure 8:
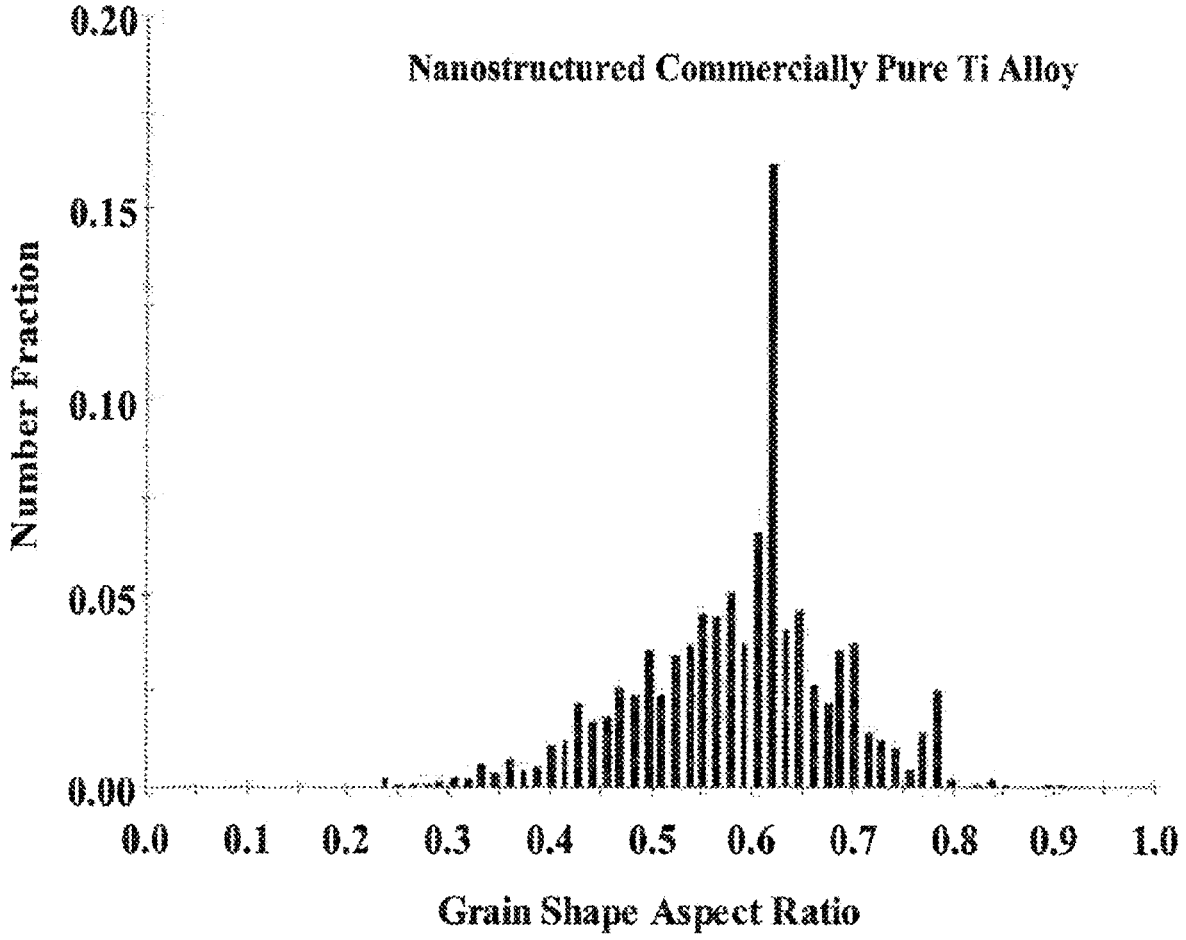
FIG. 8 is a graphical representation, obtained using electron back scatter diffraction, showing the grain shape aspect ratio distribution in the transverse plane of the nanostructured commercially pure titanium alloy according to the invention.

FIGS. 7 and 8 show the grain aspect ratio distribution in the longitudinal and transverse planes of the nanostructured commercially pure titanium alloy, which demonstrates an increased proportion of lower grain shape aspect ratio grains in the longitudinal plane compared to the transverse plane. The similar aspect ratio is observed in nanostructured Ti6Al4V and Ti6Al4V ELI alloys.

Figure 9:
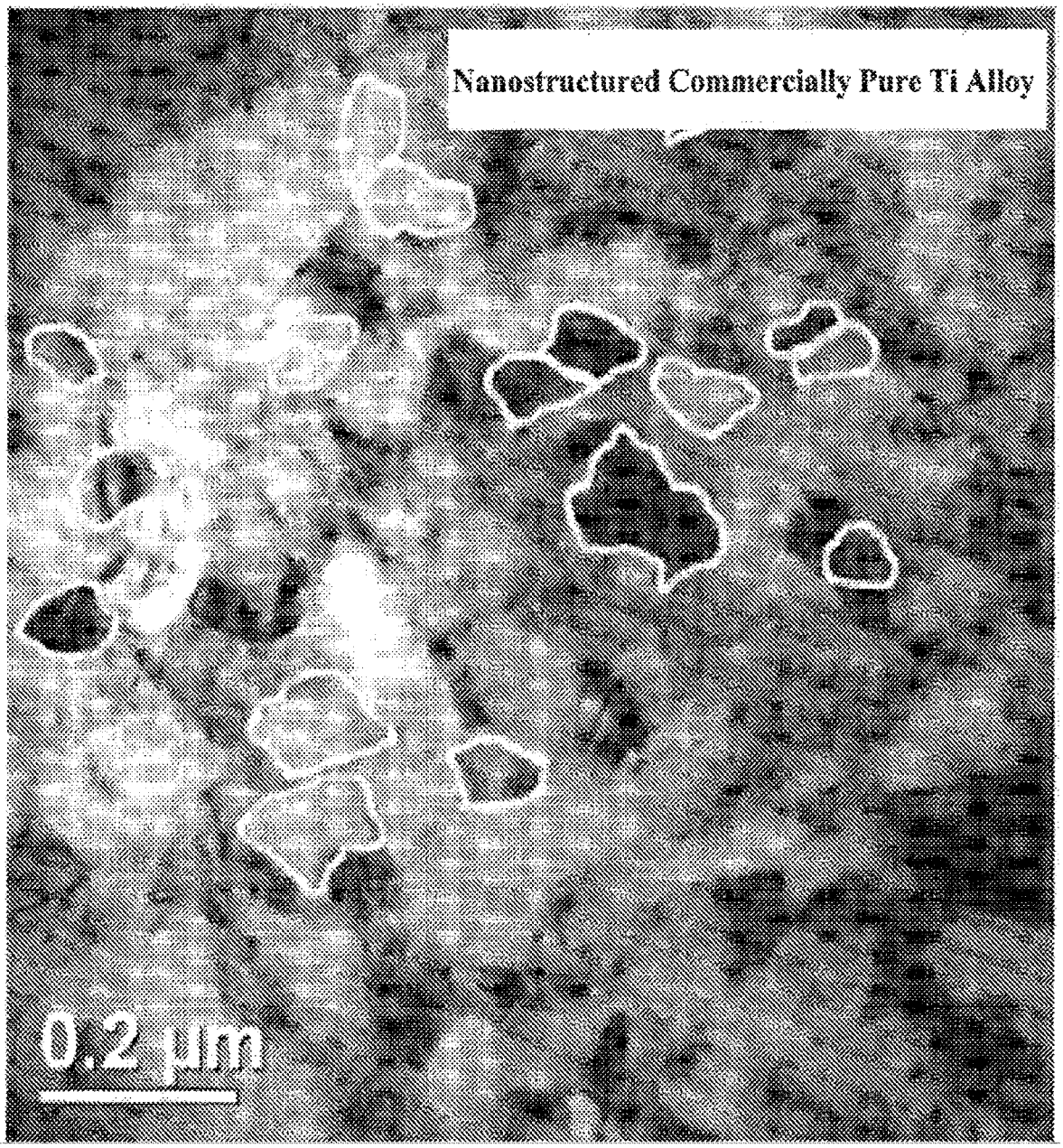
FIG. 9 is a micrograph of the commercially pure nanostructured titanium alloy according to the invention having a plurality of equiaxed grains, obtained using transmission electron microscopy.
Figure 10:
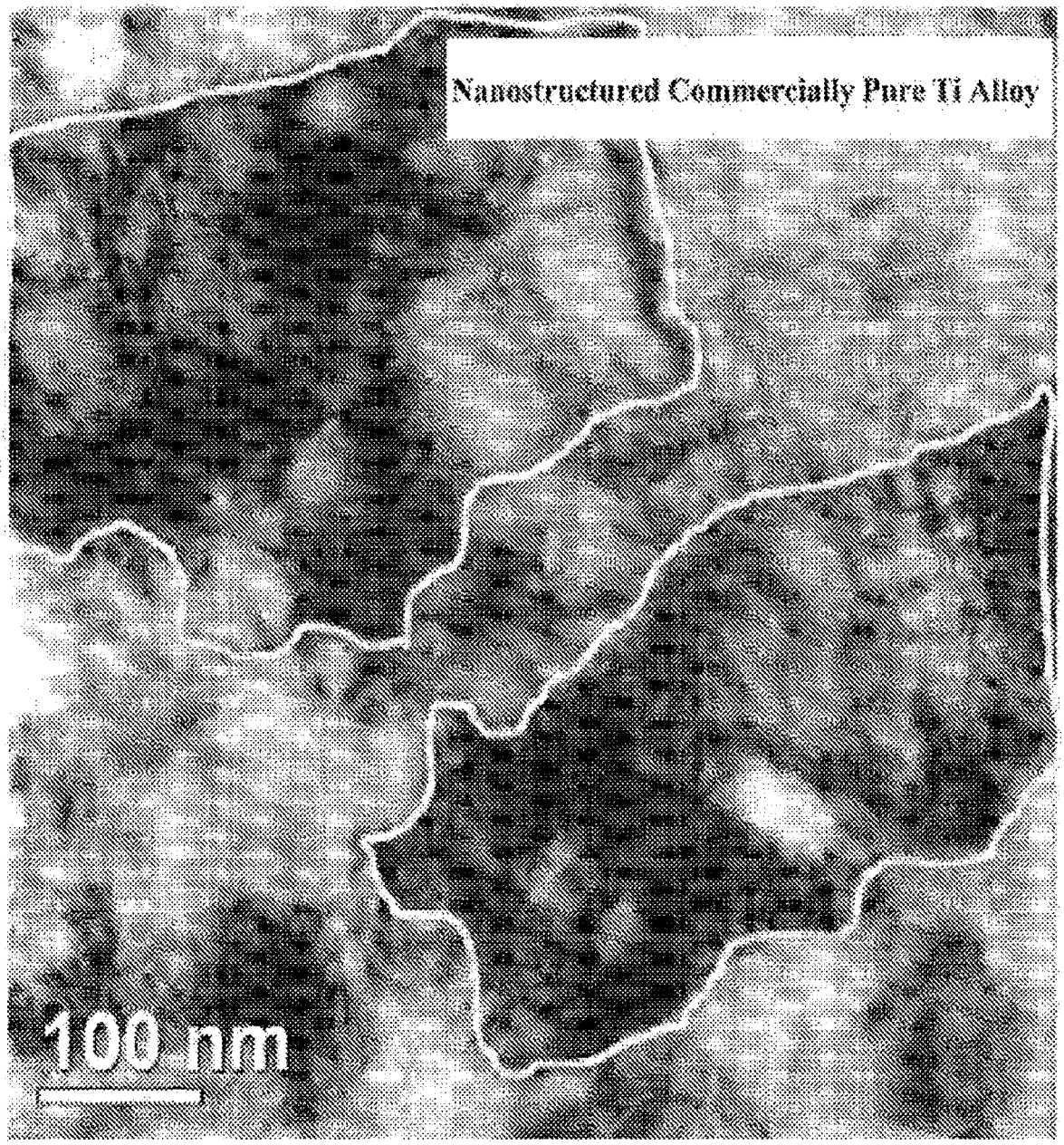
FIG. 10 is a micrograph of the commercially pure nanostructured titanium alloy according to the invention having a plurality of grains with high dislocation density, obtained using transmission electron microscopy.
Figure 11:
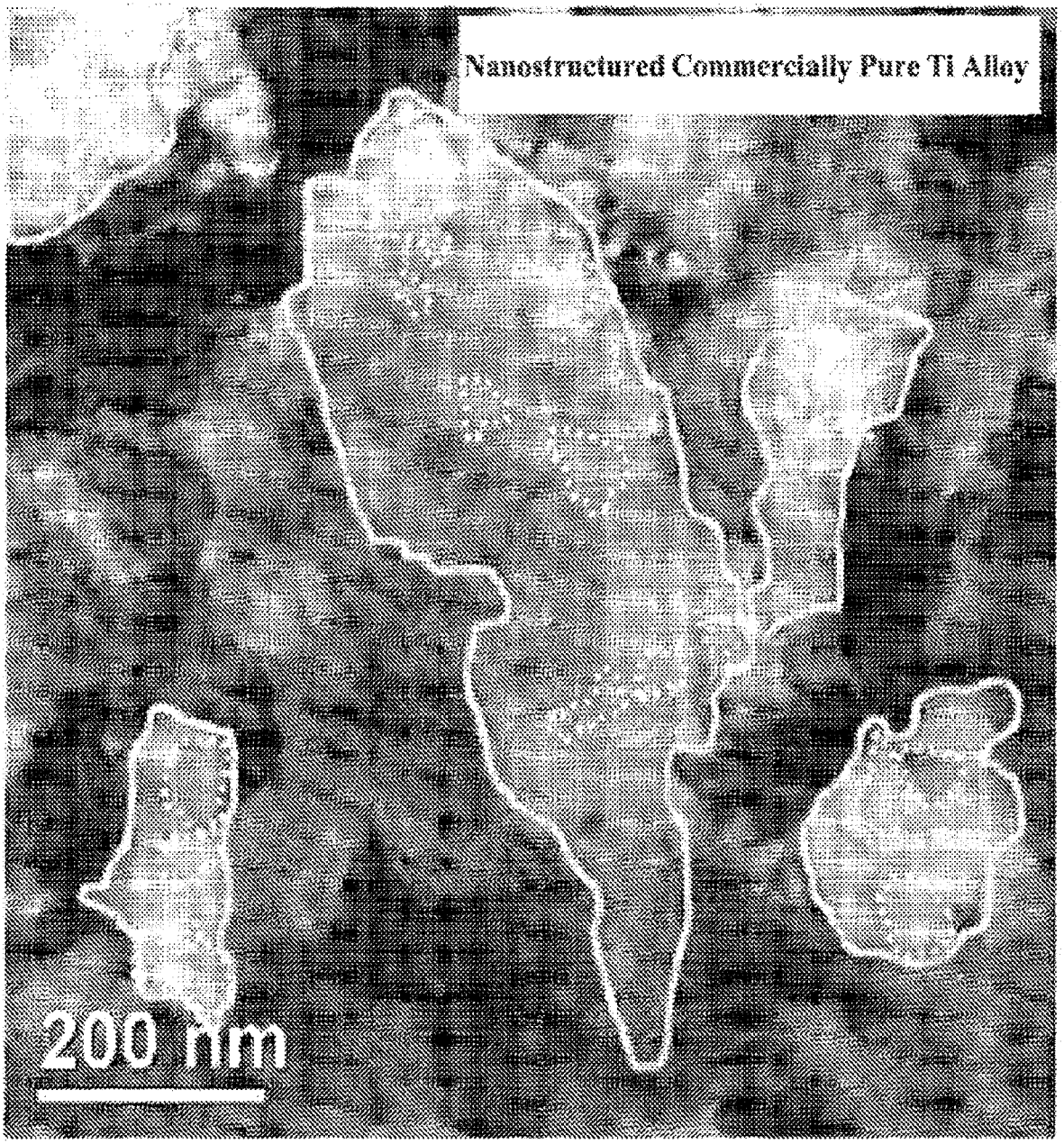
FIG. 11 is a micrograph of the commercially pure nanostructured titanium alloy according to the invention showing a plurality of sub-grains, obtained using transmission electron microscopy.

The size of these dislocation cells and subgrains can be measured by a variety of techniques including but not limited to transmission electron microscopy (TEM) and x-ray diffraction (XRD), in particular the extended-convolutional multi whole profile fitting procedure as applicable to XRD. For instance, FIGS. 9-11 are TEM micrographs showing equiaxed grains, high dislocation density, and a high number of sub-grains in the nanostructured commercially pure titanium alloy, according to the invention. In FIG. 9, the equiaxed grains are highlighted by continuous lines, while in FIG. 10 the high dislocation density regions are highlighted with continuous lines. In FIG. 11, the grains are highlighted with continuous lines and the sub-grains are highlighted with dotted lines.

Table 4 shows typical room temperature mechanical property levels of the starting titanium alloys and the nanostructured titanium alloys according to the invention that can be achieved because of structure development.

TABLE 4

| Mechanical Properties | | | | | | | |
|---|---|---|---|---|---|---|---|
| Material | Ultimate Tensile Strength (MPa) | Tensile Yield Strength (MPa) | Total Elongation (%) | Area Reduction (%) | Ultimate Shear Strength (MPa) | Axial Fatigue Endurance Limit* (MPa) | Cantilever-Rotating Beam Fatigue Endurance Limit* (MPa) |
| Known Commercially Pure Titanium Alloy | 784 | 629 | 27 | 50 | 510 | 575 | 450 |
| Nanostructured Commercially Pure Titanium Alloy | 1200 | 1050 | 10 | 25 | 650 | 700 | 650 |
| Known Titanium Alloy Ti6Al4V | 1035 | 908 | 15 | 44 | 645 | 850 | 650 |
| Nanostructured Titanium Alloy Ti6Al4V | 1450 | 1250 | 10 | 25 | 740 | 950 | 700 |
| Known Titanium Alloy Ti6Al4V ELI | 1015 | 890 | 18 | 46 | — | — | 625 |
| Nanostructured Titanium Alloy Ti6Al4V ELI | 1400 | 1250 | 10 | 25 | — | — | — |

*Fatigue endurance limit measured at $10^7$ cycles.

Table 4 clearly demonstrates that the resulting nanostructured titanium alloys exhibit various material property changes, such as increased tensile strength and/or shear strength and/or fatigue endurance limit. In particular, the nanostructured titanium alloys according to the exemplary embodiment of the invention have a total tensile elongation greater than 10% and a reduction of area greater than 25%. In addition, the nanostructured titanium alloys have at least 80% of the grains with a size ≤1.0 microns, with approximately 20-40% of all grains having high angle grain boundaries, and ≥80% of all grains have a grain shape aspect ratio in the range 0.3 to 0.7. Additionally, the nanostructured titanium alloy articles have grains with an average crystallite size below 100 nanometers and a dislocation density of $\geq 10^{15}\ m^{-2}$.

Thus, the invention provides a nanocrystalline structure having enhanced properties from the starting workpiece, as a result of severe plastic deformation and thermomechanical processing.

Titanium alloys that may be used in accordance with the present invention include commercially pure titanium alloys (Grades 1-4), Ti-6Al-4V, Ti-6Al-4V ELI, Ti—Zr, or Ti-6Al-7Nb. The nanostructured titanium alloy in accordance with the present invention can be used to produce useful articles with enhanced material properties, including aerospace fasteners, aerospace structural components, high performance sporting goods, as well as articles for medical applications, such as spinal rods, screws, intramedullary nails, bone plates and other orthopedic implants. For example, the invention may provide aerospace fasteners comprised of nanostructured Ti alloy having increased ultimate tensile strength, such as above 1200 MPa, and increased shear strength, such as above 650 MPa.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

We claim:

1. A nanostructured titanium alloy article comprising one of commercially pure titanium Grades 1-4, Ti6Al4V, Ti6Al4V-ELI, Ti6Al7Nb, or Ti—Zr, the article characterized by a developed titanium structure comprising:

≥80% area fraction of grains being of a size <1.0 micron, an average crystallite size of ≤100 nanometers, 20-40% number fraction of the grains include high angle grain boundaries with a misorientation angle ≥15°, and ≥80% number fraction of grains having a grain shape aspect ratio that is in a range of 0.3 to 0.7.

2. The nanostructured titanium alloy article according to claim 1, wherein the developed titanium structure is a developed α-titanium structure.

3. The nanostructured titanium alloy article according to claim 1, wherein the grains are a phase grains.

4. The nanostructured titanium alloy article according to claim 1, wherein the developed titanium structure has a dislocation density ≥10ˆ15 mˆ−2.

5. The nanostructured titanium alloy article according to claim 1, wherein ≥80% of the grains have a grain shape aspect ratio that is in a range of 0.3 to 0.7.

6. The nanostructured titanium alloy article according to claim 1, wherein the developed titanium structure has an ultimate tensile strength that is ≥1400 MPa.

7. The nanostructured titanium alloy article according to claim 1, wherein the developed titanium structure includes α-titanium matrix having retained β-titanium particles.

8. The nanostructured titanium alloy article according to claim 1, wherein the developed titanium structure has an ultimate tensile strength that is ≥1200 MPa.

9. The nanostructured titanium alloy article according to claim 8, wherein the developed titanium structure has a total tensile elongation ≥10%.

10. The nanostructured titanium alloy article according to claim 9, wherein the developed titanium structure has an area reduction ≥25%.

11. The nanostructured titanium alloy article according to claim 10, wherein the developed titanium structure has an ultimate shear strength that is ≥740 MPa.

12. The nanostructured titanium alloy article according to claim 10, wherein the developed titanium structure has an ultimate shear strength that is ≥650 MPa.

13. The nanostructured titanium alloy article according to claim 12, wherein the developed titanium structure has an axial fatigue endurance limit ≥700 MPa measured at 10ˆ7 cycles.

14. The nanostructured titanium alloy article according to claim 13, wherein the developed titanium structure has a cantilever-rotating beam fatigue endurance limit ≥650 MPa measured at 10ˆ7 cycles.

15. The nanostructured titanium alloy article according to claim 13, wherein the developed titanium structure has a cantilever-rotating beam fatigue endurance limit ≥700 MPa measured at 10ˆ7 cycles.

16. The nanostructured titanium alloy article according to claim 12, wherein the developed titanium structure has an axial fatigue endurance limit ≥950 MPa measured at 10ˆ7 cycles.

17. The nanostructured titanium alloy article according to claim 1, wherein the developed titanium structure has a composition by weight percent:

nitrogen (N) 0.07% maximum;
carbon (C) 0.1% maximum;
hydrogen (H) 0.015% maximum;
iron (Fe) 0.50% maximum;
oxygen (O) 0.40% maximum;
trace impurities 0.40% maximum; and
a balance of titanium (Ti).

18. The nanostructured titanium alloy article according to claim 17, wherein the developed titanium structure has a composition by weight percent:

Aluminum (Al) 6.75% maximum; and
Vanadium (V) 4.5% maximum.

19. The nanostructured titanium alloy article according to claim 17, wherein the developed titanium structure has a composition by weight percent:

Aluminum (Al) 6.5% maximum;
Niobium (Nb) 7.5% maximum; and
Tantalum (Ta) 0.5% maximum.

20. The nanostructured titanium alloy article according to claim 17, wherein the developed titanium structure has a composition by weight percent:

Zirconium (Zr) 25% maximum; and
other elements 1% maximum.

* * * * *